US012616291B2

(12) United States Patent
Chung

(10) Patent No.: US 12,616,291 B2
(45) Date of Patent: May 5, 2026

(54) REFILLABLE STICK-TYPE CONTENT CONTAINER

(71) Applicant: David C. Chung, Incheon (KR)

(72) Inventor: David C. Chung, Incheon (KR)

( * ) Notice: Subject to any disclaimer, the term of this patent is extended or adjusted under 35 U.S.C. 154(b) by 173 days.

(21) Appl. No.: 18/599,177

(22) Filed: Mar. 7, 2024

(65) Prior Publication Data

US 2025/0024932 A1 Jan. 23, 2025

(30) Foreign Application Priority Data

Jul. 21, 2023 (KR) ..... 10-2023-0095001

(51) Int. Cl.

| | |
|---|---|
| ***A45D 40/06*** | (2006.01) |
| ***A45D 40/00*** | (2006.01) |
| ***A45D 40/04*** | (2006.01) |
| ***A45D 40/10*** | (2006.01) |
| ***A45D 40/20*** | (2006.01) |
| ***B65D 83/761*** | (2025.01) |

(52) U.S. Cl.

CPC ..... *A45D 40/06* (2013.01); *A45D 40/10* (2013.01); *B65D 83/761* (2025.01); *A45D 2040/0056* (2013.01); *A45D 40/04* (2013.01); *A45D 2040/204* (2013.01); *A45D 2200/25* (2013.01)

(58) Field of Classification Search

CPC ..... A45D 4/04; A45D 40/06; A45D 40/10; A45D 2040/0056; A45D 2200/25; A45D 2040/04; B65D 83/761; B65D 83/763; B65D 83/76

USPC ..... 401/68, 70, 171–174

See application file for complete search history.

(56) References Cited

U.S. PATENT DOCUMENTS

| | | | | |
|---|---|---|---|---|
| 5,399,040 | A * | 3/1995 | Holloway | A45D 40/06 401/86 |
| 11,553,778 | B2 * | 1/2023 | Trochel | A45D 40/16 |
| 11,910,908 | B2 * | 2/2024 | Zhong | A45D 40/06 |

* cited by examiner

*Primary Examiner* — David J Walczak

(74) *Attorney, Agent, or Firm* — Bridgeway IP Law Group, PLLC; Sang Ho Lee; Hyun Woo Shin

(57) ABSTRACT

A content container includes: a base kit; and a refill kit which is separable from and combinable with the base kit and is filled with the content, wherein the base kit includes: a bottom housing having an inner space; and a screw column arranged within the bottom housing, the refill kit includes: a cylinder which is hollow and has a screw engagement protrusion formed on the inner bottom; and a holder assembly positioned within the cylinder to secure the content, the screw column includes a column body having a male screw portion formed on the outer surface thereof and a nose provided at the top of the column body, when the refill kit and the base kit are combined with each other, the male screw portion of the screw column and the screw engagement protrusion of the cylinder are screw-coupled.

10 Claims, 11 Drawing Sheets

REFILLABLE STICK-TYPE CONTENT CONTAINER

CROSS-REFERENCE TO RELATED APPLICATIONS

This application claims the priority of Korean Patent Application No. 10-2023-0095001 filed on Jul. 21, 2023, in the Korean Intellectual Property Office, the entire content of which is incorporated herein by reference.

BACKGROUND OF THE INVENTION

Field of the Invention

The present disclosure relates to a refillable stick-type content container.

Background Art

With the increasing interest in personal appearance, various types of cosmetics are emerging, among which stick-type cosmetics such as lipstick and lip balm are gaining popularity. However, cosmetic containers for such stick-type cosmetics, when the content is fully consumed, have a problem of resource waste as the cosmetic container cannot be reused and are discarded entirely.

To overcome the problem, refillable products allowing the reuse of cosmetic containers by refilling the content have been recently introduced. However, existing refillable products require cumbersome manipulation such as users directly holding and rotating or pulling the cosmetic container. So, the existing refillable products deteriorate convenience in manipulation during the refill process.

Furthermore, the existing refillable products may decrease absorption due to deteriorated adhesion of the content to the skin during the process of applying the content to the skin, and when excessive force is applied to increase adhesion, it may cause damage to the skin.

SUMMARY OF THE INVENTION

Accordingly, the present disclosure has been made to solve the above-mentioned problems occurring in the prior arts, and it is an objective of the present disclosure to provide a refillable stick-type content container.

The objectives of the present disclosure are not limited to those mentioned above, and other objectives not mentioned herein will be clearly understood by those skilled in the art from the following description.

According to an embodiment of the present disclosure, a refillable stick-type content container is provided.

The refillable stick-type content container according to an embodiment of the present disclosure includes: a base kit; and a refill kit which is separable from and combinable with the base kit and is filled with the content, wherein the base kit includes: a bottom housing having an inner space; and a screw column arranged within the bottom housing, the refill kit includes: a cylinder which is hollow and has a screw engagement protrusion formed on the inner bottom; and a holder assembly positioned within the cylinder to secure the content, the screw column includes a column body having a male screw portion formed on the outer surface thereof and a nose provided at the top of the column body, when the refill kit and the base kit are combined with each other, the male screw portion of the screw column and the screw engagement protrusion of the cylinder are screw-coupled, and the holder assembly and the nose are connected to each other, and the holder assembly and the screw column are separably combinable so that the base kit and the refill kit are also separably combined.

According to an embodiment of the present disclosure, the holder assembly includes a locking block having a hollow portion, an outer undercut is formed on the outer peripheral surface of the nose, an inner undercut is provided on the inner peripheral surface of the locking block, and when the refill kit and the base kit are combined, the outer undercut and the inner undercut are engaged with each other.

According to an embodiment of the present disclosure, the screw column includes at least one or more groove lines formed on at least one of the top portion of the column body and the nose, a pressing rib protruding outward from the thread groove portion is formed on at least a portion of the male screw portion, and when the screw engagement protrusion passes through the pressing rib, the top portion of the column body and the nose are horizontally deformed.

According to an embodiment of the present disclosure, the cylinder includes an insertion groove which is formed at the inner bottom thereof and is opened upwards, at least a portion of the holder assembly is inserted into the insertion groove, and when the cylinder descends in a state in which the refill kit and the base kit are combined with each other, the holder assembly is separated from the insertion groove.

According to an embodiment of the present disclosure, the holder assembly includes a holding block that supports the content, the holding block includes a holding head having a through hole formed in at least a portion thereof, and a least a portion of the content passes through the through hole.

According to an embodiment of the present disclosure, the holder assembly includes: a tensioner applying elasticity in the vertical direction; and a holding block supporting the content, the holding block has an insertion space in which the tensioner is accommodated at the bottom thereof, and when the refill kit and the base kit are combined, the tensioner elastically biases at least a portion between the screw column and the holding block.

According to an embodiment of the present disclosure, the tensioner includes: a lower edge portion, at least a portion of which is supported on the column body; an upper edge portion, at least a portion of which supports the holding block; and an elastic portion provided between the lower edge portion and the top edge portion, and applying elastic restoring force in the vertical direction.

According to an embodiment of the present disclosure, the holder assembly further includes a locking block connected to the nose and supported on the column body, the locking block is inserted into the insertion space of the holding block, the tensioner includes a hollow portion penetrating the lower edge portion, the upper edge portion, and the elastic portion in the vertical direction, and the locking block is positioned within the hollow portion.

According to an embodiment of the present disclosure, a displacement space whose width varies according to the vertical displacement of the holding block is formed between the upper end of the insertion space and the locking block.

According to an embodiment of the present disclosure, the locking block includes a locking head having guide grooves recessed inwardly at the top, guide protrusions are formed on the upper portion of the insertion space of the holding block to engage with the guide grooves while the locking head is inserted, and the upper edge portion of the tensioner is in contact with the guide protrusions through the guide grooves.

According to the present disclosure, the refillable stick-type content container allows for easy refilling operation of the content since the separation/connection between the base kit and the refill kit can be easily achieved.

Additionally, according to the present disclosure, the refillable stick-type content container, which includes the tensioner, can enhance user comfort during content application, and increase skin adhesion and absorption.

BRIEF DESCRIPTION OF THE DRAWINGS

A brief description of each drawing is provided to facilitate a better understanding of the drawings referred to in the detailed description of the present disclosure.

DETAILED DESCRIPTION OF THE PREFERRED EMBODIMENT

Figure 1:
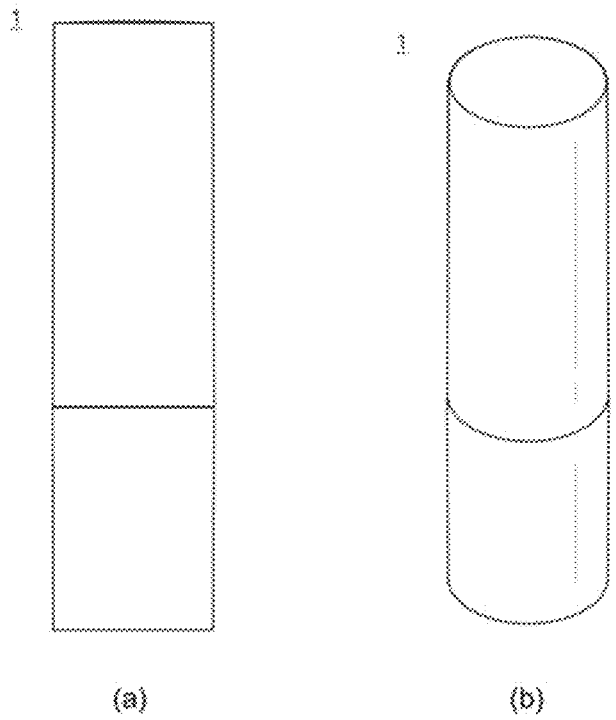
FIG. 1 is a front view and a side view of the appearance of a content container according to an embodiment of the present disclosure.

Hereinafter, exemplary embodiments according to the present disclosure will be described in detail with reference to the contents disclosed in the accompanying drawings. In addition, a method of configuring and using an apparatus according to an embodiment of the present disclosure will be described in detail with reference to the contents disclosed in the accompanying drawings. Like reference numerals or symbols illustrated in the drawings designate parts or components that perform substantially the same functions. For convenience of description, the upward, downward, leftward, and rightward directions are based on the drawings, and the scope of the present disclosure is not necessarily limited in the corresponding directions.

It will be understood that terms, such as "first" or "second" may be used in the specification to describe various components but are not restricted to the above terms. The terms may be used to discriminate one component from another component. For instance, the first component may be named as the second component, and on the contrary, the second component may be also named as the first component within the scope of the present disclosure. The term, "and/or", includes a combination of a plurality of related items or any one item among the plurality of related items.

It will be further understood that the words or terms used in the present disclosure are used to describe specific embodiments of the present disclosure and there is no intent to limit the present disclosure. The singular form of the components may be understood into the plural form unless otherwise specifically stated in the context. It should be also understood that the terms of 'include' or 'have' in the specification are used to mean that there are characteristics, numbers, steps, operations, components, parts, or combinations of the steps, operations, components and parts described in the specification and there is no intent to exclude existence or possibility of other characteristics, numbers, steps, operations, components, parts, or combinations of the steps, operations, components and parts.

Throughout the specification, when a portion is connected to another portion, it may be directly connected to the other portion, or may be indirectly connected to the other portion with another configuration interposed therebetween. In addition, when a portion includes a component, it means that other components may be further included, rather than excluding other components unless otherwise stated.

FIGS. 1(*a*) and 1(*b*) are respectively a front view and a perspective view of the appearance of a content container according to an embodiment of the present disclosure. In an embodiment, the content container according to the present disclosure may be in the form of a stick-type container with a long vertical shape. However, the shape of the container is not limited thereto.

Referring to FIG. 1, the content container 1 may include a base kit 100 and a refill kit 200.

<Base Kit 100>

Figure 2:
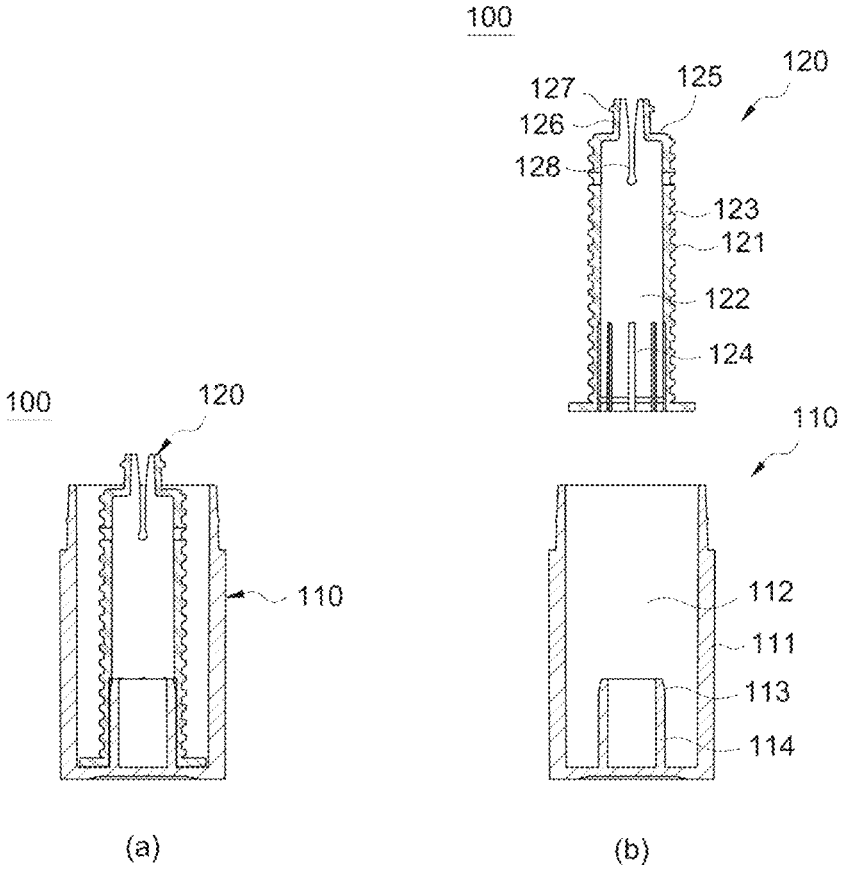
FIG. 2 is a sectional view and an exploded sectional view of a base kit of the content container according to an embodiment of the present disclosure.

FIGS. 2(*a*) and 2(*b*) are a sectional view and an exploded sectional view of the base kit 100 of the content container 1 according to an embodiment of the present disclosure, respectively.

The base kit 100 constitutes a lower part of the content container 1. The base kit 100 may include a bottom housing 110 and a screw column 120.

<Bottom Housing 110>

The bottom housing 110 forms the appearance of the lower part of the content container 1. The bottom housing 110 may have an overall cylindrical shape. The bottom housing 110 includes: an outer barrel 111 having a housing space 112 with an open upper portion; and a column fixing part 113 provided within the outer barrel 111. The column fixing part 113 serves to fix the screw column 120, and may stand inside the housing space 112 and have a fixing protrusion 114 protruding outwards. The fixing protrusion 114 may be a vertical protrusion extending in the vertical direction.

<Screw Column 120>

The screw column 120 is arranged within the bottom housing 110, and serves as a component that is separated from/connected to the refill kit 200 and can guide the vertical displacement of the refill kit 200.

The screw column 120 may include a column body 121 with a male screw portion 123 formed on the outer periphery thereof, and a nose 126 provided on the column body 121 and protruding upwards.

An insertion space 122 may be provided inside the column body 121, and a fixing groove 124 may be on the inner periphery of the insertion space 122. The fixing groove 124 may be a vertical groove extending in the vertical direction. A stepped portion may be provided at the top of the column body 121, and a support surface 125 may be provided on the stepped portion.

An outer undercut 127 protruding outwards may be provided on the outer periphery of the nose 126.

A groove line 128 may be formed across an upper portion of the column body 121 and the top of the nose 126. The groove line 128 has a groove partially partitioning the upper portion of the column body 121 and the nose 126 in the horizontal direction. Therefore, when external force is applied, a shape transformation may occur to reduce the width of the nose 126 and the top of the column body 121. When the external force is removed, the shape may be restored.

<Combination of Bottom Housing 110 and Screw Column 120>

The screw column 120 is inserted into the housing space 112 of the bottom housing 110, and the column fixing part 113 is inserted into the insertion space 122 of the screw column 120 so that the bottom housing 110 and the screw column 120 can be coupled together. In this instance, according to an embodiment, the fixing protrusion of the column fixing part 113 is inserted into the fixing groove 124 of the screw column 120, such that the screw column 120 can be fixed within the housing space 112 of the bottom housing 110.

<Refill Kit 200>

Figure 3:
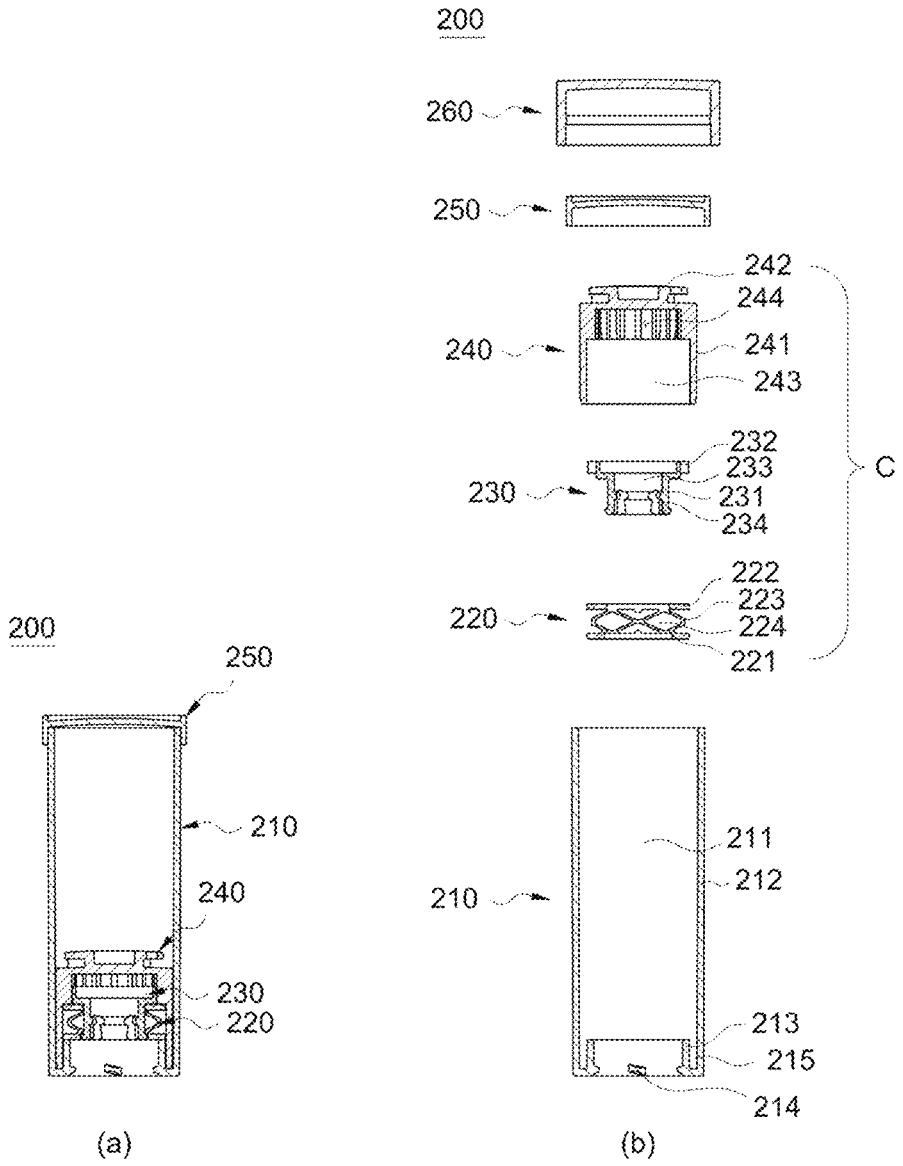
FIG. 3 is a sectional view and an exploded sectional view of a refill kit of the content container according to an embodiment of the present disclosure.
Figure 4:
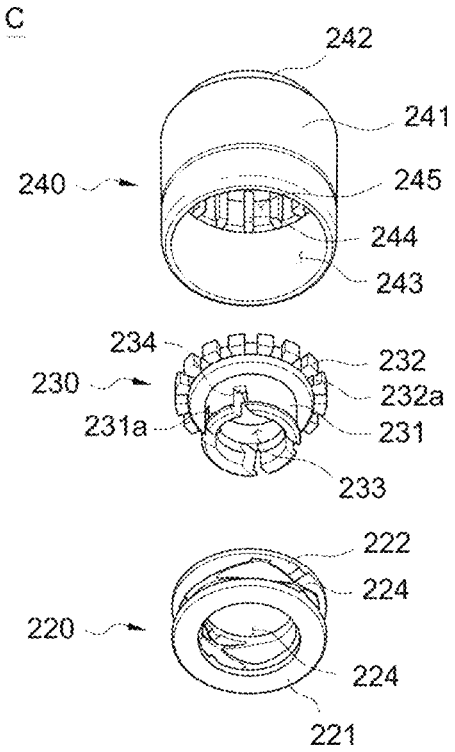
FIG. 4 is an exploded view illustrating a holder assembly of the refill kit of the content container according to an embodiment of the present disclosure.
Figure 5:
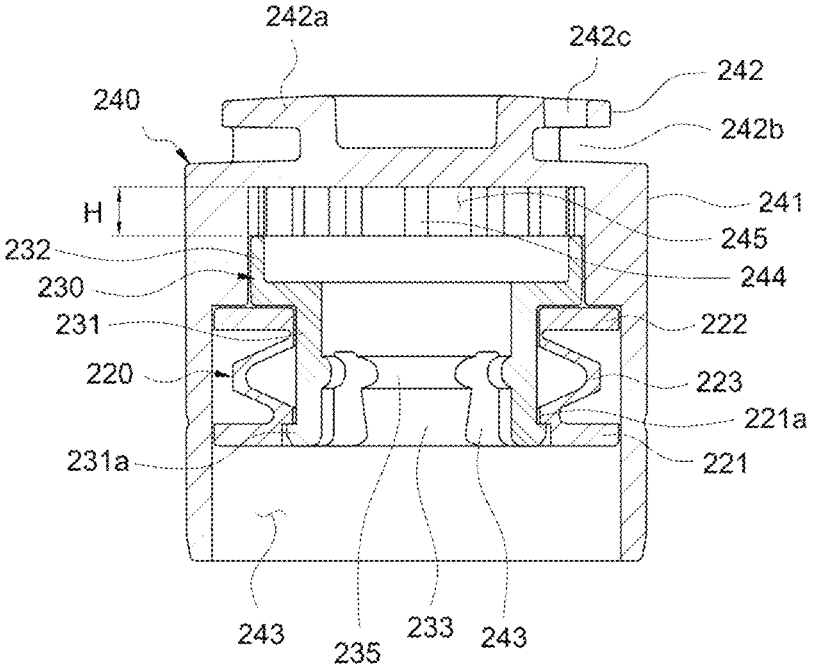
FIG. 5 is a sectional view illustrating a cross-section of the holder assembly of the refill kit of the content container according to an embodiment of the present disclosure.

FIGS. 3(*a*) and 3(*b*) are a sectional view and an exploded sectional view of the refill kit 200 of the content container 1 according to an embodiment of the present disclosure, respectively. FIG. 4 is an exploded view of a holder assembly C of the refill kit 200 of the content container 1 according to an embodiment of the present disclosure. FIG. 5 is a sectional view of the holder assembly C of the refill kit 200 of the content container 1 according to an embodiment of the present disclosure.

The refill kit 200 may include a cylinder 210, a tensioner 220, a locking block 230, and a holding block 240. The tensioner 220, the locking block 230, and the holding block 240 may form a holder assembly C. Additionally, the refill kit 200 may further include a first cap 250.

<Cylinder 210>

The cylinder 210 accommodates the content, and can rise or fall to expose or accommodate the content outwardly or inwardly. According to an embodiment, the cylinder 210 may have an overall cylindrical pipe shape with predetermined inner diameter and outer diameter.

In an embodiment, the cylinder 210 may include a receiving space 211, an outer wall 212, an inner wall 213, a screw engagement protrusion 214, and an insertion groove 215.

The receiving space 211 is a space formed inside the cylinder 210, and can accommodate at least a portion of the content. The receiving space 211 may have a hollow shape vertically open inside the cylinder 210. Here, the content may be solid or semi-solid cosmetics applied to a user's skin. For example, the content may be lipstick, lip balm, sunscreen, sunblock, base, foundation, etc. Additionally, the content may include solid or semi-solid medical content. However, the content is not limited thereto, and may include various compositions that may be provided in a solid or semi-solid form, and include various types of cosmetics or other formulations.

The outer wall 212 defines the outer circumference of the cylinder 210. Therefore, the receiving space 211 is provided on the inner surface of the outer wall 212.

The inner wall 213 is provided at the bottom of the cylinder 210. The inner wall 213 is provided inside the outer wall 212, and the inner wall 213 and the outer wall 212 may form a concentric circle. The inner wall 213 has a smaller height than the outer wall 212.

The screw engagement protrusion 214 is provided on the inner surface of the inner wall 213. The screw engagement protrusion 214 is a protrusion projecting inwardly of the cylinder 210. The screw engagement protrusion 214 may be plural in number, which are provided along the inner periphery of the inner wall 213.

The insertion groove 215 has an insertion space formed between the outer wall 212 and the inner wall 213. The insertion groove 215 is open in the upward direction, and has a depth corresponding to the height of the inner wall 213.

<Tensioner 220>

The tensioner 220 is a component capable of applying elasticity in the vertical direction.

According to an embodiment, the tensioner 220 may include a lower edge portion 221, an upper edge portion 222, and an elastic portion 223 between the lower edge portion 221 and the upper edge portion 222. Additionally, the tensioner 220 may include a tensioner hollow portion 224 penetrating the upper edge portion 222, the lower edge portion 221, and the elastic portion 223 in the vertical direction.

The lower edge portion 221 and the upper edge portion 222 may have a ring shape. The elastic portion 223 is located between the lower edge portion 221 and the upper edge portion 222, and may have elastic restoring force. According to an embodiment, the elastic portion 223 may have a grid structure in which a plurality of diagonal bars capable of being compressively strained cross, but is not necessarily limited thereto, and for example, a spring may be provided between the lower edge portion 221 and the upper edge portion 222.

In an embodiment, the tensioner 220 of the present disclosure may be made of a material with the same line as other components. For example, the elastic member may be made of a flexible plastic material.

<Locking Block 230>

The locking block 230 is a component capable of being substantially separated from/connected to the screw column 120.

The locking block 230 may include a pipe-shaped locking body 231 with predetermined inner diameter and outer diameter, and a locking head 232 provided at an upper portion of the locking body 231 and protruding outwardly more than the locking body 231. In addition, the locking block 230 may include a locking block hollow portion 233 penetrating the locking body 231 and the locking head 232 in the vertical direction.

A plurality of guide grooves 232*a* recessed inwards may be formed on the outer circumference of the locking head 232.

The locking body 231 may have at least one or more locking block groove lines 234 at the bottom thereof. The locking block groove lines 234 are configured as grooves partially partitioning the bottom of the locking body 231 in the horizontal direction. Therefore, when external force is applied, a shape transformation may occur to reduce the width of the bottom portion of the locking body 231. When the external force is removed, the shape may be restored.

An inner undercut 235 protruding inwardly may be provided on the inner periphery of the locking body 231.

A retaining protrusion 231*a* protruding outwards may be formed on the outer circumference of the bottom portion of the locking body 231.

<Holding Block 240>

The holding block 240 is a component capable of accommodating the tensioner 220 and the locking block 230 and fixing and supporting the content.

The holding block 240 may include an insertion body 241 and a content maintenance head 242.

The insertion body 241 forms a lower portion of the holding block 240. The insertion body 241 includes an insertion space 243 open downwards. A plurality of guide protrusions 244 protruding inwardly may be provided at an upper portion of the inside of the insertion space 243.

The content maintenance head 242 forms an upper portion of the holding block 240. The content maintenance head 242 includes a holding head 242*a* with predetermined width and area, and a neck 242*b* provided below the holding head 242*a*, and a through-hole 242*c* may be formed in the holding head 242*a*.

<Structure of Holder Assembly C: Combination Relationship of Tensioner 220, Locking Block 230, and Holding Block 240>

Referring back to FIGS. 4 through 5, the combination relationship among the tensioner 220, the locking block 230, and the holding block 240 will be described as follows.

First, the combination between the tensioner 220 and the locking block 230 is as follows.

The locking body 231 of the locking block 230 may be inserted into the hollow portion 224 of the tensioner 220. According to an embodiment, the locking body 231 of the locking block 230 and the tensioner hollow portion 224 of the tensioner 220 may have corresponding shapes and sizes. When the locking body 231 of the locking block 230 is inserted into the hollow portion 224 of the tensioner 220, the upper edge portion 222 of the tensioner 220 can get in contact with the lower portion of the locking head 232 of the locking block 230. In this case, according to an embodiment, a coupling groove 221*a* may be provided on the lower edge of the tensioner 220, and the retaining protrusion 231*a* may be provided at the bottom of the locking block 230, such that the retaining protrusion 231*a* can be coupled to the coupling groove 221*a*.

When observing the combination of the tensioner 220 and the locking block 230, at least a portion of the upper edge of the tensioner 220 can be exposed upwards through the guide groove 232*a* of the locking block 230.

The combination of the tensioner 220 and the locking block 230 can be inserted into the insertion space 243 of the holding block 240. Once the locking block 230 is sufficiently inserted, the guide protrusions 244 of the holding block 240 can be positioned to fit into the guide grooves 232*a* formed in the locking head 232 of the locking block 230 within the insertion space 243. Therefore, the locking block 230 can be combined with the holding block 240 within the holding block 240 without rotation. In this instance, as illustrated in FIG. 5, at least a portion of the upper edge portion 222 of the tensioner 220 can be exposed upwards through the guide grooves 232*a*, and can get in contact with the lower portions of the guide protrusions 244 of the holding block 240. A displacement space 245 with a predetermined width H can be provided between the top of the locking block 230 and the top of the insertion space 243 of the holding block 240. Depending on the relative vertical displacement between the locking block 230 and the holding block 240, the width H of the displacement space 245 can vary.

<Coupling Relationship of Refill Kit 200>

Figure 6:
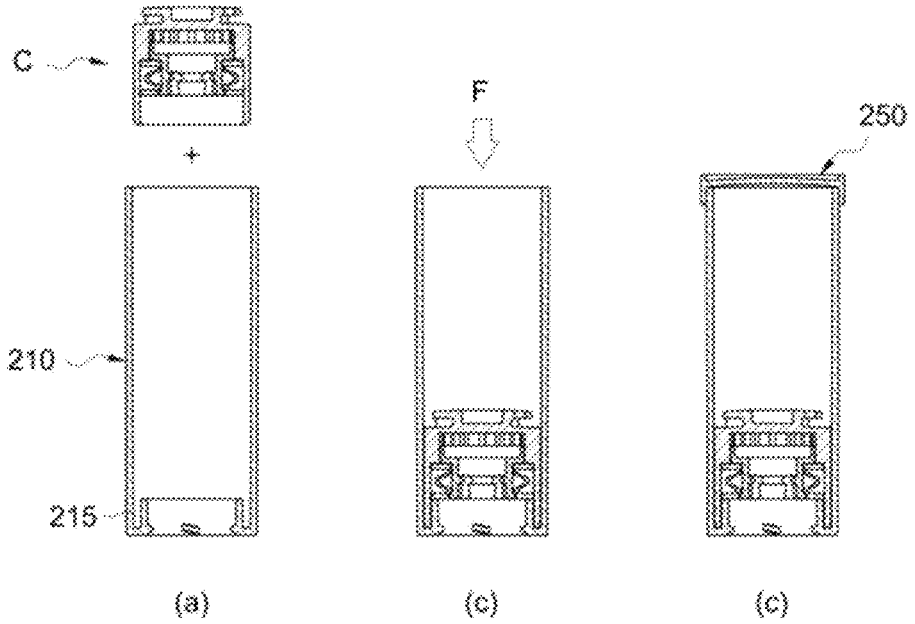
FIG. 6 is a diagram illustrating a coupling process of the refill kit of the content container according to an embodiment of the present disclosure.

FIGS. 6(*a*), 6(*b*), and 6(*c*) are diagrams illustrating a coupling process of the refill kit 200 of the content container 1 according to an embodiment of the present disclosure in order.

By inserting the holder assembly C into the receiving space 211 of the cylinder 210, the coupling between the cylinder 210 and the holder assembly C can be achieved. Furthermore, the receiving space 211 can be filled with content and sealed with the first cap 250.

A detailed description will be described as follows.

First, as illustrated in FIG. 6(*a*), when the holder assembly C is inserted from above the receiving space 211 of the cylinder 210 and falls down or is pushed downward until the bottom portion of the holding block 240 of the holder assembly C is inserted into the insertion groove 215 of the cylinder 210, the coupling between the cylinder 210 and the holder assembly C can be achieved. According to an embodiment, once the bottom portion of the holding block 240 is inserted and fixed into the insertion groove 215 of the cylinder 210, the lower edge portion 221 of the tensioner 220 can be supported on the inner wall 213 of the cylinder 210.

Subsequently, as indicated by the arrow F in FIG. 6(*b*), the receiving space 211 on the holder assembly C is filled with the content. The content filled into the receiving space 211 is as described earlier. According to an embodiment, the content retention head 242 of the holding block 240 forming the upper portion of the holder assembly C includes a holding head 242*a* with predetermined width and area, a neck portion 242*b* provided at a lower portion of the holding head 242*a*, and a hole 242*c* formed in the holding head 242*a*. Therefore, at least a portion of the content can be solidified or semi-solidified in a ring shape that passes through the hole 242*c* and penetrates at least a portion of the holding head 242*a*. Therefore, the content can be coupled with the holder assembly C more effectively.

Next, as illustrated in FIG. 6(*c*), the first cap 250 can be coupled to the upper portion of the cylinder 210 to seal the receiving space 211. The first cap 250 can wrap around at least a portion of the content and the cylinder 210, and can be detachably coupled to the cylinder 210. The first cap 250 can open or seal the top of the cylinder 210 to expose the content to the outside or prevent foreign substances from sticking to the content.

<Coupling Relationship Between Base Kit 100 and Refill Kit 200>

Figure 7:
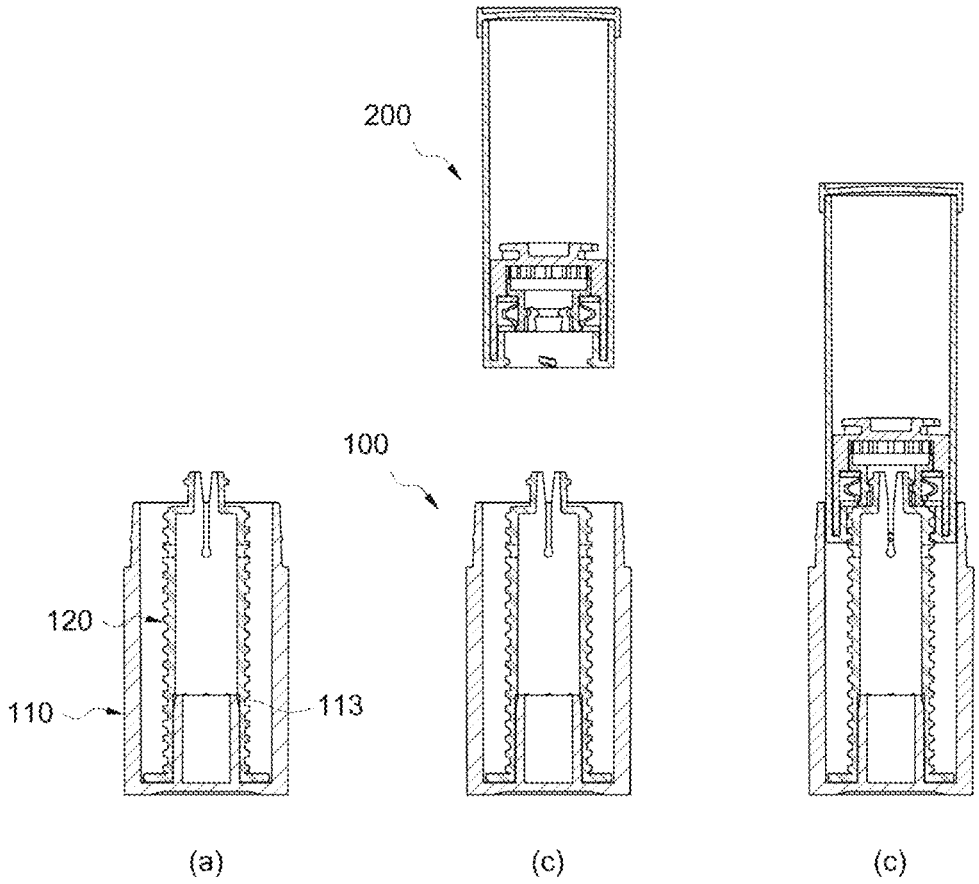
FIG. 7 is a diagram showing the coupling process of the base kit and the refill kit of the content container according to an embodiment of the present disclosure.
Figure 8:
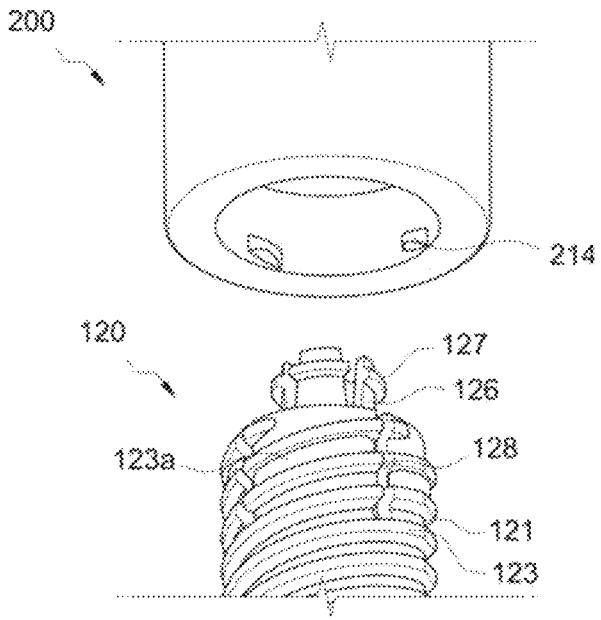
FIGS. 8 and 9 are diagrams illustrating the coupling between a cylinder and a screw column in the coupling process of the base kit and the refill kit of the content container according to an embodiment of the present disclosure.
Figure 9:
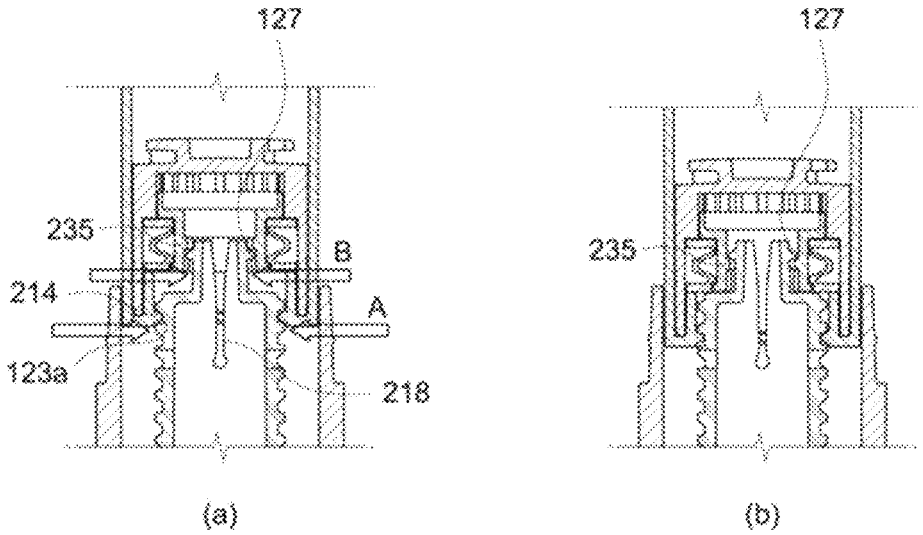

FIGS. 7(*a*), 7(*b*), and 7(*c*) are diagrams illustrating a coupling process of the base kit 100 and refill kit 200 of the content container 1 according to an embodiment of the present disclosure. FIGS. 8 and 9 are diagrams illustrating the coupling between the cylinder 210 and the screw column 120 in the coupling process of the base kit 100 and refill kit 200 of the content container 1 according to an embodiment of the present disclosure.

The coupling relationship between the base kit 100 and the refill kit 200 is as follows.

As illustrated in FIG. 8, the refill kit 200 can be coupled to the base kit 100 such that the screw column 120 of the base kit 100 and the holder assembly C of the refill kit 200 are interconnected.

Specifically, the screw engagement protrusion 214 formed on the inner wall 213 of the cylinder 210 can be screw-coupled to the male screw portion 123 of the screw column 120. Moreover, the nose 126 of the screw column 120 can be inserted into the locking block hollow portion 233 of the locking block 230 of the holder assembly C.

Referring to FIG. 9, the coupling process will be described in more detail. FIG. 9(*a*) illustrates the state before the inner undercut 235 and the outer undercut 127 engage with each other, and FIG. 9(*b*) illustrates the state after the inner undercut 235 and the outer undercut 127 engage with each other.

In an upper area of the male screw portion 123 provided on the column body 121 of the screw column 120, a pressing rib 123*a* protruding more outward than other portions may be provided. The area where the pressing rib 123*a* is formed is a thread groove area of the male screw portion 123. During threadedly connecting the screw engagement protrusion 214 to the male screw portion 123 of the screw column 120, when the screw engagement protrusion 214 passes through the pressing rib 123*a*, the pressing rib 123*a* which protrudes outwards receives inward force by the screw engagement protrusion 214. Therefore, as illustrated in FIG. 9(*a*), the screw engagement protrusion 214 pushes the screw column 120 inwards as indicated by the arrow A to transform the screw column 120. The transformation may be achieved in the form of reducing the width of the nose 126 as indicated by the arrow B as well as the upper portion of the column body 121 by the groove lines 128 formed on the upper portion of the screw column 120. Since the width of the nose 126 is reduced, the outer undercut 127 formed on the nose 126 can pass through the inner undercut 235 of the locking block 230 without engagement.

Next, as illustrated in FIG. 9(*b*), when the screw engagement protrusion 214 passes through the pressing rib 123*a*, the upper portion of the column body 121 and the nose 126 of the screw column 120 are restored to their original shapes. Therefore, the outer undercut 127 on the nose 126 and the inner undercut 235 of the locking block 230 can engage with each other.

As illustrated in FIG. 9(*b*), when the refill kit 200 descends to a position where the bottom of the locking block 230 is in contact with the top of the screw column 120, the coupling between the base kit 100 and the refill kit 200 is completed.

In this state, the tensioner 220 is positioned on the support surface 125 formed on the top of the screw column 120. That is, the lower edge portion 221 of the tensioner 220 is in contact with the screw column 120. Accordingly, the tensioner 220 is supported on the screw column 120 and elastically biases the holding block 240 in the upward direction.

The separation between the base kit 100 and the refill kit 200 can be performed in the opposite direction to the coupling process.

As described above, the coupling/separation between the base kit 100 and the refill kit 200 can be achieved easily, thereby improving user convenience and reducing waste generation.

Meanwhile, after the base kit 100 and the refill kit 200 are coupled to each other, an external cap can be further coupled. For example, FIG. 1 illustrates a state where the external cap is additionally coupled. By coupling the external cap, the appearance of the content container 1 can be more aesthetically pleasing.

<Exposure of Content>

In the state where the coupling between the base kit 100 and the refill kit 200 is completed (when reaching the position where the bottom of the locking block 230 gets in contact with the support surface 125 of the screw column 120), when the cylinder 210 is further rotated in the direction of descending, the content inside the cylinder 210 can be exposed upward.

Figure 10:
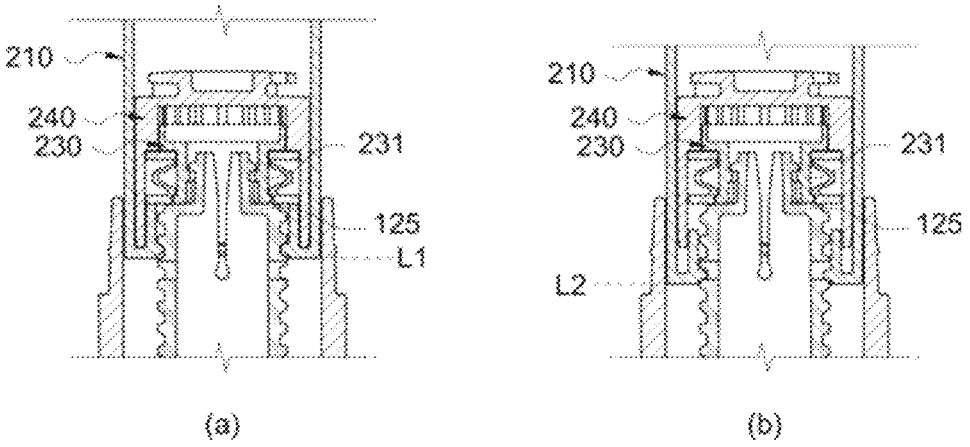
FIG. 10 is a diagram illustrating the operation of manipulating the cylinder of the content container according to an embodiment of the present disclosure to expose the content.

FIG. 10 illustrates a state of exposing the content by manipulating the cylinder 210 of the content container 1 according to an embodiment of the present disclosure. FIG. 10(*b*) illustrates a state in which the cylinder 210 is lowered further than the cylinder 210 of FIG. 10(*a*). In FIG. 10(*a*), the bottom of the cylinder 210 is located at a predetermined position L1, and in (b), the bottom of the cylinder 210 is located at a predetermined position L2 where the cylinder 210 is further lowered. As described above, as the cylinder 210 descends, the content inside the cylinder 210 can be more exposed externally.

Referring to FIG. 10, the present disclosure will be described in more detail as follows.

When the cylinder 210 is further rotated in the direction of descending, the cylinder 210 can descend independently of the holder assembly C. The coupling relationship between the cylinder 210 and the holder assembly C is achieved not by fixedly coupling the cylinder 210 and the holder assembly C but by inserting a portion of the holder assembly C (the bottom portion of the holding block 240) into the insertion groove 215 of the cylinder 210, since the holder assembly C can be freely separated from the insertion groove 215.

Regardless of the descent of the cylinder 210, the holder assembly C remains in position. Because the bottom portion of the locking block 230 is in contact with the support surface 125 of the screw column 120, the holder assembly C is supported to maintain the position. Therefore, the locking block 230 maintains its position without displacement. In addition, the tensioner 220 is also positioned on the top of the screw column 120 and maintains the position. Since the holding block 240 positioned on the tensioner 220 receives upward elastic force, the holding block 240 also maintains its position. Thus, the holder assembly C and the content on the holder assembly C maintain their positions in common.

Since the holder assembly C maintains its position and only the cylinder 210 descends, the content inside the cylinder 210 can be exposed externally. So, the user can use the content.

<Operation of Holder Assembly C During Content Dispensing>

Figure 11:
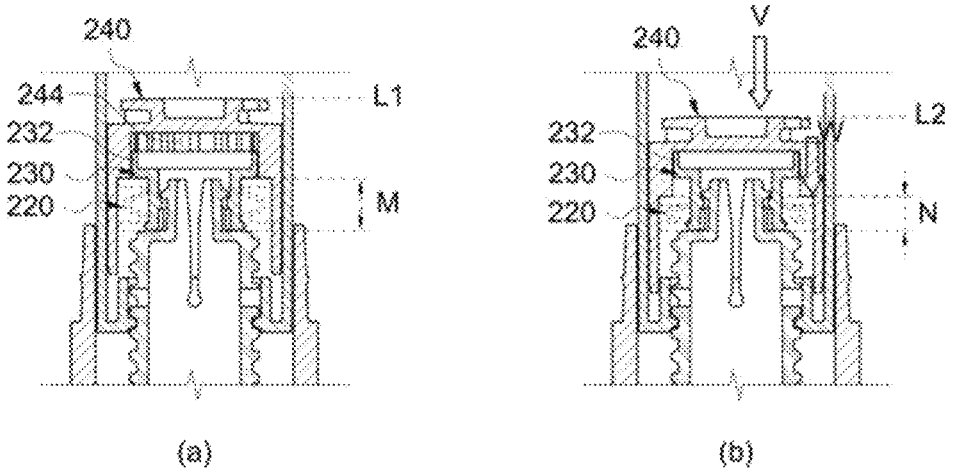
FIG. 11 is a diagram illustrating the operation of the holder assembly when external force is applied to the content during a use process of the content container according to an embodiment of the present disclosure.

FIG. 11 illustrates the operation of the holder assembly C when external force is applied to the content during the use process of the content container 1 according to an embodiment of the present disclosure. FIG. 11(*a*) illustrates the state before external force is applied to the content, and FIG. 11(*b*) illustrates the state where downward external force is applied as indicated by the arrow V, to compress the tensioner 220 as indicated by the arrow W.

The operation of the holder assembly C when the content is exposed and the user uses the content will be described as follows with reference to FIG. 11.

As described above, the content may be solid or semi-solid cosmetics applied to the user's skin.

In the process of using the content, it is necessary to apply pressure to the skin to apply the content on the skin. During the process, if the position of the contents is fixed, excessive pressure may be applied to the user's skin.

According to an embodiment, the holding block 240 of the holder assembly C is supported by the tensioner 220. Therefore, when the content is applied to the user's skin, the content can be applied with appropriate pressure to the user's skin by being elastic deformed, so that the content can be applied to the skin.

For example, during the process of applying the content, external force, indicated by the arrow V in FIG. 11(*b*), can be applied. According to the embodiment, a displacement space of a predetermined width is formed between the holding block 240 and the locking block 230 of the holder assembly C. When such external force is applied, the holding block 240 of the holder assembly C can descend. Specifically, the position of the top portion of the holding block 240 descends from L1 to L2. At this time, the downward displacement width of the holding block 240 is equal to the width H of the displacement space 245.

In this instance, as the holding block 240 descends, the vertical width of the tensioner 220 is compressed (M→N), and the compressed tensioner 220 can apply upward elastic force to the holding block 240. Therefore, when the content is applied to the user's skin, the content descends by a predetermined width, and at the same time, elastic force is applied to the content and the user's skin by the tensioner 220. Consequently, the content can adhere to the user's skin more effectively, and the sensation applied to the user's skin during application can be enhanced.

According to an embodiment of the present disclosure, during content application, user convenience is improved, sensation is enhanced, and unintended skin damage can be prevented. Additionally, during content application, user sensation can be enhanced, and skin adhesion and absorption can be strengthened.

As described above, the optimal embodiments have been disclosed in the drawings and the specification. Specific terms have been used herein for descriptive purposes, not for purposes of limitation of meanings or to limit the scope of the invention as set forth in the claims. Therefore, it would be understood by those skilled in the art that various modifications and equivalent embodiments are possible from the present disclosure. Accordingly, the true scope of protection of the present disclosure should be determined by the technical concept of the attached claims.

What is claimed is:

1. A content container comprising:

a base kit; and a refill kit which is separable from and combinable with the base kit and is filled with content, wherein the base kit comprises:

a bottom housing having an inner space; and a screw column arranged within the bottom housing, wherein the refill kit comprises:

a cylinder which is hollow and has a screw engagement protrusion formed on an inner bottom; and a holder assembly positioned within the cylinder to secure the content, wherein the screw column comprises a column body having a male screw portion formed on an outer surface thereof and a nose provided at a top of the column body, wherein when the refill kit and the base kit are combined with each other, the male screw portion of the screw column and the screw engagement protrusion of the cylinder are screw-coupled, and the holder assembly and the nose are connected to each other, and wherein the holder assembly and the screw column are separably combinable, so that the base kit and the refill kit are also separably combined.

2. The content container according to claim 1, wherein the holder assembly comprises a locking block having a hollow portion, wherein an outer undercut is formed on an outer peripheral surface of the nose, wherein an inner undercut is provided on an inner peripheral surface of the locking block, and wherein when the refill kit and the base kit are combined, the outer undercut and the inner undercut are engaged with each other.

3. The content container according to claim 2, wherein the screw column includes at least one or more groove lines formed on at least one of a top portion of the column body and the nose, wherein a pressing rib protruding outward from a thread groove portion is formed on at least a portion of the male screw portion, and wherein when the screw engagement protrusion passes through the pressing rib, the top portion of the column body and the nose are horizontally deformed.

4. The content container according to claim 1, wherein the cylinder includes an insertion groove which is formed at the inner bottom thereof and is opened upwards, wherein at least a portion of the holder assembly is inserted into the insertion groove, and wherein when the cylinder descends in a state in which the refill kit and the base kit are combined with each other, the holder assembly is separated from the insertion groove.

5. The content container according to claim 1, wherein the holder assembly includes a holding block that supports the content, wherein the holding block includes a holding head having a through hole formed in at least a portion thereof, and wherein a least a portion of the content passes through the through hole.

6. The content container according to claim 1, wherein the holder assembly comprises:

a tensioner applying elasticity in a vertical direction; and a holding block supporting the content, wherein the holding block has an insertion space in which the tensioner is accommodated at the bottom thereof, and wherein when the refill kit and the base kit are combined, the tensioner elastically biases at least a portion between the screw column and the holding block.

7. The content container according to claim 6, wherein the tensioner comprises:

a lower edge portion, at least a portion of which is supported on the column body;

an upper edge portion, at least a portion of which supports the holding block; and an elastic portion provided between the lower edge portion and the upper edge portion, and applying elastic restoring force in the vertical direction.

8. The content container according to claim 7, wherein the holder assembly further comprises a locking block connected to the nose and supported on the column body, wherein the locking block is inserted into the insertion space of the holding block, wherein the tensioner includes a hollow portion penetrating the lower edge portion, the upper edge portion, and the elastic portion in the vertical direction, and wherein the locking block is positioned within the hollow portion.

9. The content container according to claim 8, wherein a displacement space whose width varies according to a vertical displacement of the holding block is formed between an upper end of the insertion space and the locking block.

10. The content container according to claim 8, wherein the locking block includes a locking head having guide grooves recessed inwardly at the top, wherein on an upper portion of the insertion space of the holding block, guide protrusions are formed to engage with the guide grooves while the locking head is inserted, and wherein the upper edge portion of the tensioner is in contact with the guide protrusions through the guide grooves.

* * * * *